US005915390A

United States Patent [19]

Daughtry

[11] Patent Number: 5,915,390

[45] Date of Patent: Jun. 29, 1999

[54] LIQUID HAIR TREATMENT DISPENSER AND DISPENSER HEAD

[76] Inventor: Fredrick Daughtry, 1621 18th Ave. West, Bradenton, Fla. 34205

[21] Appl. No.: 08/936,252

[22] Filed: Sep. 24, 1997

[51] Int. Cl.[6] ..... A45D 24/22

[52] U.S. Cl. ..... 132/112; 132/320

[58] Field of Search ..... 132/320, 270, 132/112, 113, 114, 115, 116; 401/268

[56] References Cited

U.S. PATENT DOCUMENTS

| | | | |
|---|---|---|---|
| 2,359,427 | 10/1944 | Lamont | 132/112 X |
| 4,209,027 | 6/1980 | Morganroth | 401/281 X |
| 5,152,305 | 10/1992 | Niv | 132/116 X |

FOREIGN PATENT DOCUMENTS

| | | | |
|---|---|---|---|
| 3520255 | 12/1985 | Germany | 132/112 |
| 3931111 | 3/1991 | Germany | 132/112 |

*Primary Examiner*—Steven A. Bratlie
*Attorney, Agent, or Firm*—Charles J. Prescott

[57] ABSTRACT

A liquid hair treatment dispenser and dispenser head therefor. The dispenser includes a bottle for containing a quantity of liquid hair treatment and the dispenser head which connects to an open end of the bottle. The dispenser head includes stiff bristles which extend, preferably longitudinally upwardly, and liquid outlet apertures for dispensing the liquid hair treatment into the bristles by gravity feed and bottle squeezing. A slender, elongated hair parting member is pivotally connected at one end to a base portion of the dispenser head. The hair parting member, preferably substantially straight, readily available during liquid hair treatment application, is quickly positionable between a closed or non-use position against the bottle and an in-use position laterally extended at an angle of about at least 45° with respect to a longitudinal axis of the bottle.

3 Claims, 2 Drawing Sheets

FIG. 1
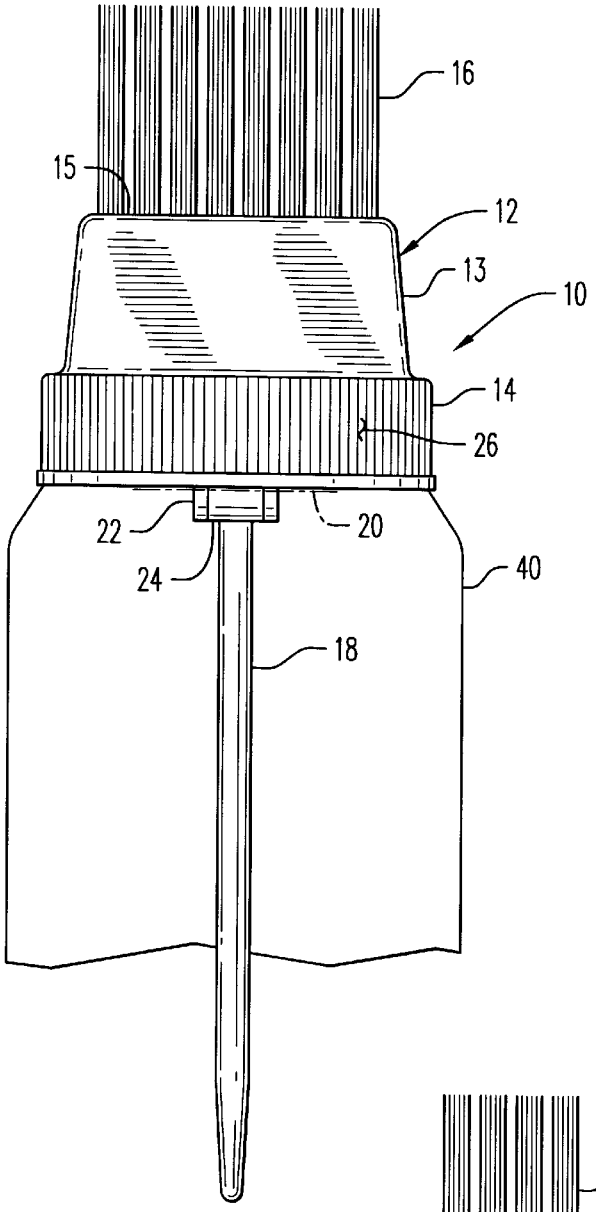
FIG. 2
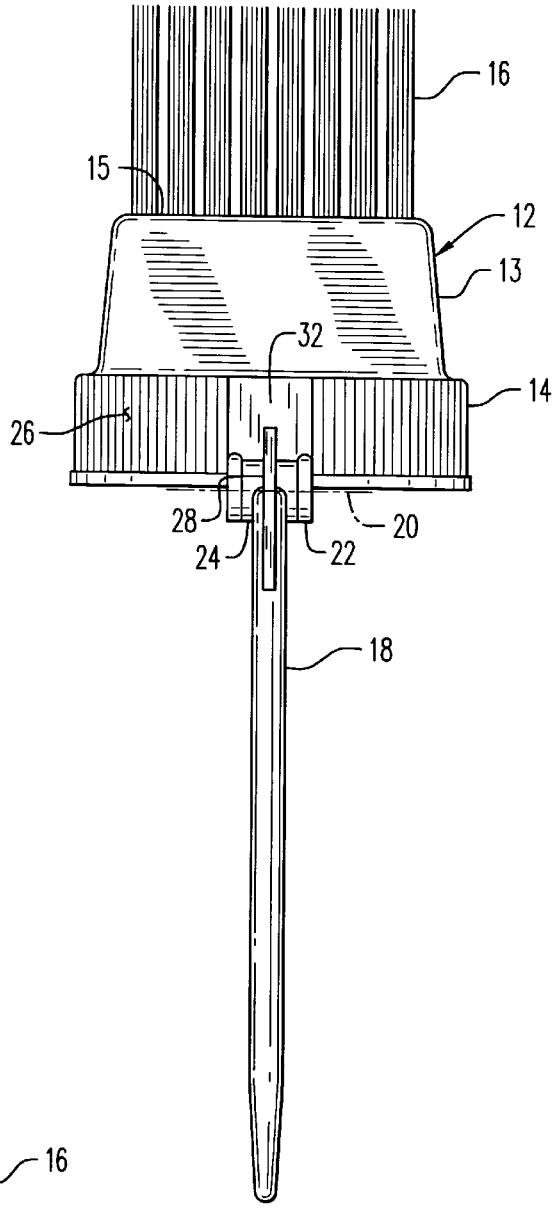
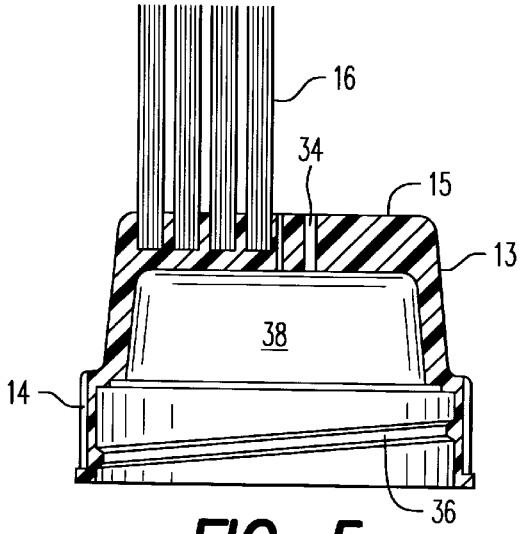
FIG. 5

LIQUID HAIR TREATMENT DISPENSER AND DISPENSER HEAD

BACKGROUND OF THE INVENTION

1. Scope of Invention

This invention relates generally to articles used in the hair salon industry, and more particularly to a liquid treatment dispenser and dispenser head therefor used during hair treatment and conditioning.

2. Prior Art

The application of various hair treatments, done either professionally at a hair salon or in the home, include a broad range of articles which facilitate such treatment. One such process is for applying liquid hair treatment, by example, the application of hair coloring, tints or dyes. Typically, a squeeze bottle dispenser is used with a separate brush or comb for working the liquid down into the roots of the hair as well as evenly throughout the hair strands. To facilitate this procedure, typically a rattail comb or other implement having an elongated, slender curved or straight "rattail"-shaped member is utilized to part sections of the hair in side by side fashion one after another so that the application of the conditioning or coloring liquid will more effectively reach the roots of the hair. But this prior procedure requires two or three separate implements and is thus very clumsy at best.

Applicant is unaware of any combination device which will serve the multi-functioned needs of the present invention in a single unit. Those functions include holding and dispensing a quantity of liquid hair treatment, working the liquid hair treatment into the roots of, and throughout the hair, and parting the hair repeatedly for quicker, enhanced liquid penetration to the roots.

BRIEF SUMMARY OF THE INVENTION

This invention is directed to a liquid hair treatment dispenser and dispenser head therefor. The dispenser includes a bottle for containing a quantity of liquid hair treatment and the dispenser head which connects to an open end of the bottle. The dispenser head includes stiff bristles which extend, preferably longitudinally upwardly, and liquid outlet apertures for dispensing the liquid hair treatment into the bristles by gravity feed and bottle squeezing. A slender, elongated hair parting member is pivotally connected at one end to a base portion of the dispenser head. The hair parting member, preferably substantially straight, readily available during liquid hair treatment application, is quickly positionable between a closed or non-use position against the bottle and an in-use position laterally extended at an angle of about at least 45° with respect to a longitudinal axis of the bottle.

It is therefore an object of this invention to provide a liquid hair treatment dispenser and dispenser head therefor which will hold and easily dispense liquid hair treatment.

It is another object of this invention to provide a liquid hair treatment dispenser and dispenser head therefor which will facilitate the parting of hair and the massage brushing of liquid hair treatment down into the roots of the hair.

It is yet another object of this invention to provide a liquid hair treatment dispenser and dispenser head therefor which includes an easily positionable elongated slender rattail-shaped member which facilitates the parting of the hair in repeated fashion for more effective liquid hair treatment.

In accordance with these and other objects which will become apparent hereinafter, the instant invention will now be described with reference to the accompanying drawings.

BRIEF DESCRIPTION OF THE DRAWINGS

FIG. 1 is a right side elevation view of the liquid hair treatment dispenser.

FIG. 2 is a left side elevation view of the dispenser head of FIG. 1.

FIG. 5 is a section view in the direction of arrows 5—5 in FIG. 4 absent a portion of the bristle bundles for clarity.

DETAILED DESCRIPTION OF THE INVENTION

Figure 4:
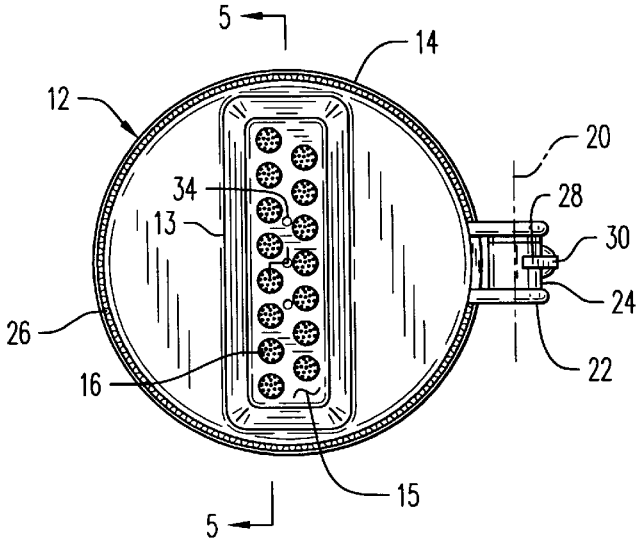
FIG. 4 is a top plan view of the invention shown in FIG. 3.

Referring now to the drawings, the liquid hair treatment dispenser is shown generally at numeral 10 and includes a dispenser head shown generally at 12 and a storage bottle or container 40, preferably squeezable plastic in nature. The upper open end of the bottle 40 is adapted for threadable engagement into a threaded cavity 36 of a lower or base portion 14 of a plastic molded hollow body 13. The dispenser head 12 also includes grasping ribs 26 extending around the base portion 14 and an upper hollow portion 13 defining an internal cavity 38. Housing 13 is molded of plastic material.

The dispenser head 12 also includes a plurality of bundles of somewhat stiff elongated straight bristles shown typically at 16. Each of the bristle bundles 16 as best seen in FIG. 5 are embedded in a conventional fashion into cavities molded into the plastic housing 13. As best seen in FIG. 4, the array of bristle bundles 16 is defined by two separate rows of bristle bundles 16 which extend across the to surface 15 of the upper housing 13. A plurality of liquid dispensing apertures 34 are also provided in the upper surface 15 of housing 13. As best seen in FIG. 5, these apertures 34 extend into the interior volume 38 and are thus in fluid communication with the contents of the bottle 40.

In use, the dispenser 10, the bottle 40 having been previously at least partially filled with liquid hair treatment, is pointed downwardly in the vicinity of the hair to be treated whereupon the liquid hair treatment such as hair coloring will typically flow downwardly by gravity into the bristles 16 through apertures 34. Squeezing of the flexible plastic bottle 40 will facilitate this process. The bristles 16 are then utilized to massage and work the liquid hair treatment all the way down to the roots of the hair, as well as throughout all of the hair strands in a uniform fashion as desired.

Figure 3:
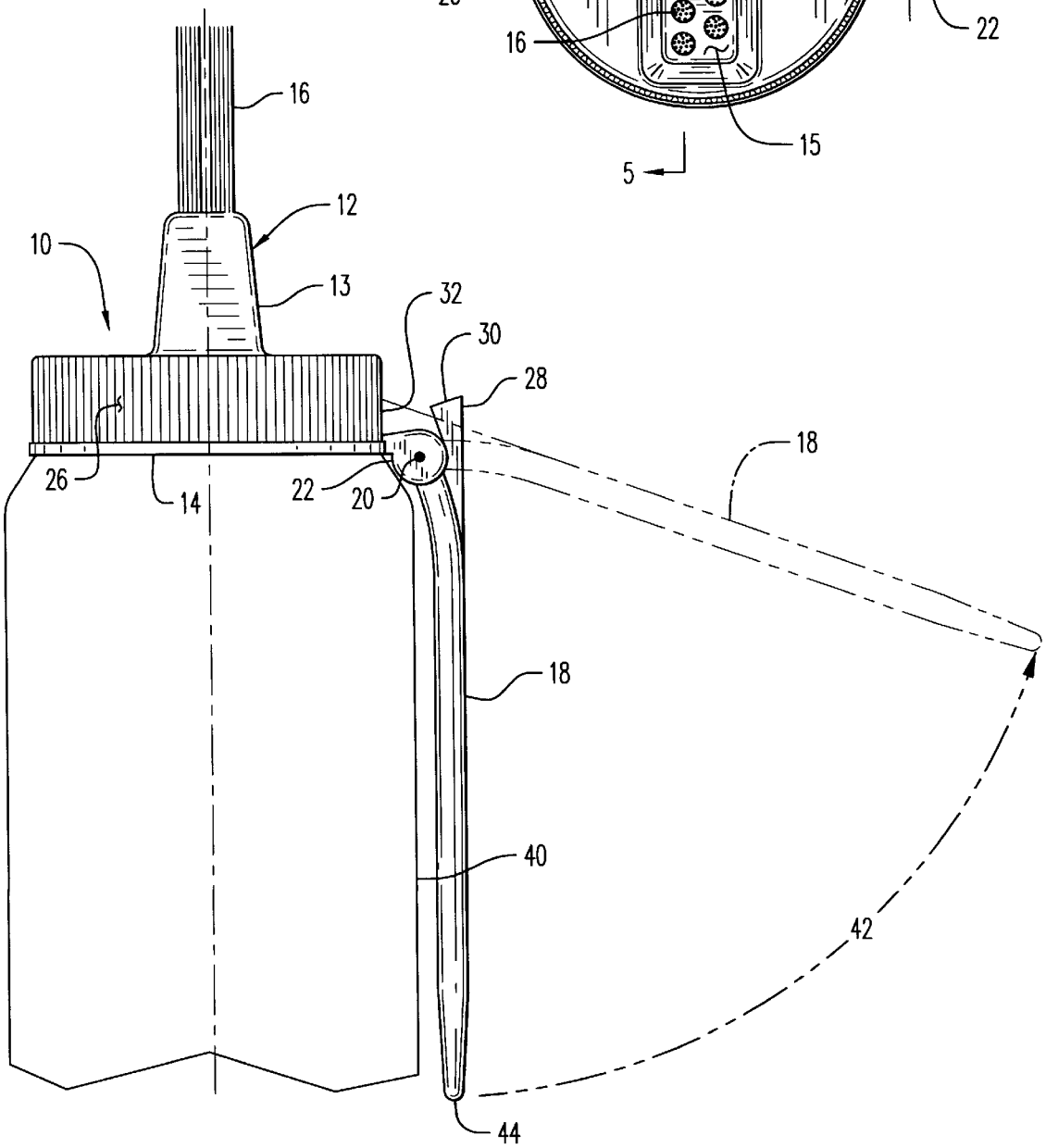
FIG. 3 is a front elevation view of the dispenser head shown in the stored position of the elongated hair parting member in solid lines and in an in-use position in phantom.

To facilitate this liquid hair treatment spreading process, an elongated rattail-shaped hair parting member 18 is also provided. This hair parting member 18 is pivotally to device 22 which is integrally or unitarily formed with housing 13. By this arrangement, the hair parting member 18 is pivotable in the direction of arrow 42 in FIG. 3 from a non-use or stored position against the side wall of the bottle 40 as shown in solid lines to a laterally extended in-use position shown in phantom. A stop 28 is integrally formed with the hair parting member 18 which provides an abutting surface 30 which limits the movement into the position shown in phantom by contact against surface 32 of the base portion 14.

By this arrangement, the hair parting member 18, having a slender elongated cylindrical structure which narrows to a somewhat rounded distal end 44, may be easily and quickly moved from the stored position against the side of the bottle

40 to the in-use position oriented preferably at an angle of greater than 45°, less than 90°, with respect to the longitudinal axis of the bottle 40 and dispenser head 12. Providing the stop 28 affords the user the ability to exert greater pressure in the hair parting procedure without the need for separately grasping the hair parting member 18 which would likely otherwise pivot somewhat freely into a less workable orientation.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A liquid hair treatment dispenser head comprising:

a hollow body adapted for attachment with an open upper end of a bottle containing a quantity of liquid hair treatment;

an array of stiff bristles connected to and extending from said hollow body;

an aperture formed through said hollow body for conveying the liquid hair treatment by gravity into said array of bristles from the bottle containing the liquid hair treatment to which said dispenser head is attached;

an elongated, slender non-fluid communicating hair parting member pivotally connected at one end thereof to said hollow body about pivotal axis substantially orthogonal to a longitudinal axis of said hollow body, a distal end thereof being somewhat pointed and adapted in length and width to easily part hair of various, lengths and conditions;

said hair parting member pivotally movable between a non-use downwardly extending position and an in-use laterally extending position stop means for limiting pivotal lateral extending movement of said hair parting member and establishing said in-use position of said hair parting member to be at an acute angle of substantially less than 90° with respect to said longitudinal axis.

2. A liquid hair treatment dispenser consisting of:

a bottle having an opening at an upper end thereof for containing a quantity of liquid hair treatment;

a dispenser head including a hollow body adapted for attachment with said opening of said bottle;

an array of stiff bristles connected to and extending upward from said hollow body;

apertures formed through said hollow body for conveying the liquid hair treatment by gravity from said bottle into said array of bristles;

an elongated, slender non-fluid communicating hair parting member pivotally connected at one end thereof to said hollow body, a distal end thereof being somewhat pointed and adapted in length and width to easily part hair of various lengths and conditions;

said hair parting member pivotally movable between a non-use downwardly extending position in close proximity to a side wall of said bottle and an in-use laterally extending position stop means formed as a unit with, and at a proximal end of, said hair parting member for limiting laterally outward pivotal movement of said hair parting member and establishing said in-use position to be substantially less than 90° with respect to a common longitudinal axis of said bottle and said hollow body.

3. A liquid hair treatment dispenser head consisting essentially of:

a hollow body adapted for attachment with an open upper end of a bottle containing a quantity of liquid hair treatment;

an array of stiff bristles connected to and extending from said hollow body;

apertures formed through said hollow body for conveying the liquid hair treatment by gravity into said array of bristles from the bottle containing the liquid hair treatment to which said dispenser head is attached;

an elongated, slender non-fluid communicating hair parting member pivotally connected at one end thereof to said hollow body about a pivotal axis substantially orthogonal to a longitudinal axis of said hollow body, a distal end thereof being somewhat pointed and adapted in length and width to easily part hair of various lengths and conditions;

said hair parting member pivotally movable between a non-use downwardly extending position and an in-use laterally extending position;

stop means for limiting pivotal lateral extending movement of said hair parting member and establishing said in-use position of said hair parting member to be at an acute angle of substantially less than 90° with respect to said longitudinal axis.

* * * * *